US012396551B2

(12) United States Patent
Tsai

(10) Patent No.: US 12,396,551 B2
(45) Date of Patent: Aug. 26, 2025

(54) FOLDING TABLE

(71) Applicant: SPORT DIVERSIONS INC., Taipei (TW)

(72) Inventor: Yi-Ting Tsai, Taipei (TW)

(73) Assignee: SPORT DIVERSIONS INC., Taipei (TW)

( * ) Notice: Subject to any disclaimer, the term of this patent is extended or adjusted under 35 U.S.C. 154(b) by 0 days.

(21) Appl. No.: 18/423,339

(22) Filed: Jan. 26, 2024

(65) Prior Publication Data

US 2025/0241439 A1 Jul. 31, 2025

(51) Int. Cl.

| | |
|---|---|
| ***A47B 3/06*** | (2006.01) |
| ***A47B 3/091*** | (2006.01) |
| ***A47B 3/12*** | (2006.01) |
| *A47B 3/10* | (2006.01) |

(52) U.S. Cl.

CPC ..... *A47B 3/06* (2013.01); *A47B 3/0918* (2013.01); *A47B 3/12* (2013.01); *A47B 3/10* (2013.01)

(58) Field of Classification Search

CPC .. A47B 3/06; A47B 3/02; A47B 3/083; A47B 3/0918; A47B 3/12; A47B 3/10; A47B 3/087; A47B 3/002; A47B 3/0912; A47B 13/003; A47B 13/02

USPC ..... 108/153.1, 163, 168

See application file for complete search history.

(56) References Cited

U.S. PATENT DOCUMENTS

| | | | | |
|---|---|---|---|---|
| 1,377,102 | A * | 5/1921 | Stambaugh | A47B 3/087 108/171 |
| 2,643,926 | A * | 6/1953 | Pucci | A47B 3/083 108/174 |
| 2,803,033 | A * | 8/1957 | Rachman | F16C 11/04 16/326 |
| 6,199,489 | B1 * | 3/2001 | Tsai | A47B 3/12 108/115 |
| 6,874,427 | B2 * | 4/2005 | Izumi | A47B 3/14 108/34 |
| 7,278,361 | B2 * | 10/2007 | Zhurong | A47B 3/0912 108/169 |
| 7,337,731 | B2 * | 3/2008 | Mu | A47B 3/00 108/132 |
| 8,408,145 | B2 * | 4/2013 | Chen | A47B 1/04 108/115 |
| 8,555,789 | B2 * | 10/2013 | Jin | A47B 3/087 108/132 |
| 8,555,791 | B2 * | 10/2013 | Jin | A47B 3/0818 108/174 |

(Continued)

FOREIGN PATENT DOCUMENTS

KR 102322736 B1 * 11/2021

*Primary Examiner* — Daniel J Troy
*Assistant Examiner* — Timothy M Ayres

(57) ABSTRACT

A folding table includes a table frame, having two crossbars and a plurality of stands, the two crossbars each have a folding portion, the plurality of stands are respectively pivoted to two ends of the two crossbars; a table plate, detachably mounted on the two crossbars; and at least one gravity lock, disposed at the folding portion, the gravity lock has a body provided with two longitudinal long grooves, two side sheets are respectively located at two sides of the body, one end of the two side sheets is combined with the crossbar, and the other end is pivoted to the body, the two side sheets each have a hook portion to shade a partial opening of a slot.

6 Claims, 12 Drawing Sheets

(56) References Cited

U.S. PATENT DOCUMENTS

| | | | | |
|---|---|---|---|---|
| 8,667,907 | B2 * | 3/2014 | Grace | A47B 3/002<br>108/116 |
| 9,277,808 | B2 * | 3/2016 | Cai | A47B 3/087 |
| 9,380,862 | B1 * | 7/2016 | Lin | A47B 3/087 |
| 10,477,961 | B2 * | 11/2019 | Heim | A47B 13/088 |
| 11,517,105 | B1 * | 12/2022 | Olsen | A47B 3/10 |
| 11,825,939 | B1 * | 11/2023 | Tsai | A47B 3/087 |
| 11,882,930 | B2 * | 1/2024 | Choi | A47B 3/0913 |
| 11,986,088 | B2 * | 5/2024 | Choi | A47B 3/0912 |
| 2010/0192812 | A1 * | 8/2010 | Yul | A47B 13/003<br>108/50.11 |
| 2023/0346117 | A1 * | 11/2023 | Tsai | A47B 3/10 |

* cited by examiner

FOLDING TABLE

BACKGROUND OF THE INVENTION

1. Field of the Invention

The present disclosure relates to a table, in particular to a folding table that can be folded into a small volume for storage or carrying.

2. Description of the Related Art

The table plate and table legs of the common traditional folding table are fixed and non-detachable, but the table plate can be retracted to one side of the table legs by pivoting relative to the table legs, and the unfolded table legs can also be folded in the same direction, so that when the folding table is switched from an unfolded state to a folded state, the thickness in a single direction can be reduced, so as to reduce the storage space occupied.

BRIEF SUMMARY OF THE INVENTION

However, even if the traditional folding table is folded, the overall volume of the folding table is still too large to place into a narrow space (such as the rear compartment of a car), thus limiting the convenience of the user when storing or moving such tables; for occasions where the table needs to be carried frequently and used outdoors, such as outdoor banquets or camping, the traditional folding table is not suitable.

Furthermore, when the traditional folding table is switched to the unfolded or folded state, additional operations are required to lock or unlock the locking mechanism, so the operating convenience and efficiency are not good.

In view of the above prior art, the disclosure provides a folding table, wherein the table plate and the table frame are detachable, and at least the table frame can be folded into a small volume; in addition, the locking mechanism of the folding table can be automatically locked or unlocked according to the use state.

The directionality or similar terms thereof described in the full text of the present disclosure, such as "front", "rear", "left", "right", "upper (top)", "lower (bottom)", "inner", "outer", "side", etc., are mainly with reference to the direction of the attached drawings, and each directionality or similar terms thereof are only used to assist in explaining and understanding the embodiments of the present disclosure, and are not used to limit the present disclosure.

The use of the quantifier "a" or "one" in the elements and components described in the full text of the present disclosure is only for convenience of use and to provide a common meaning of the scope of the present disclosure; in the present disclosure, it should be construed to include one or at least one, and a singular concept also includes the plural case, unless it is expressly intended to mean something else.

The similar terms such as "combine", "fit together" or "assemble" mentioned in the full text of the present disclosure mainly include the forms in which the components can be separated without destroying after being connected, or the components are inseparable after being connected, etc., which can be selected by a person having ordinary knowledge in the art according to the material or assembly requirements of the components to be connected.

To achieve the above objective and other objectives, the present disclosure provides a folding table, including: a table frame, having a first crossbar, a second crossbar, two first side stands and two second side stands, the first crossbar and the second crossbar each have a folding portion, the two first side stands are respectively pivoted to first ends of the first crossbar and the second crossbar, and two second side stands are respectively pivoted to second ends of the first crossbar and the second crossbar, a first side support set is respectively pivoted to the two first side stands by two upper junctions and two lower junctions; a second side support set is respectively pivoted to the two second side stands by two upper junctions and two lower junctions; a table plate, when the table frame is in an unfolded state, the table plate is detachably mounted on the first crossbar and the second crossbar; and at least one gravity lock, disposed at the folding portion of the first crossbar and/or the folding portion of the second crossbar, the gravity lock has a body, a lock lever and two side sheets, the body is provided with two longitudinal long grooves, the two side sheets are respectively located at two sides of the body, one end of the two side sheets is combined with the first crossbar or the second crossbar, and the other end is pivoted to the body by a pivot portion, the two side sheets are each provided with a slot, and a first end of the slot is closer to the pivot portion than a second end, the two side sheets each have a hook portion extending from the first end to the second end of the slot to shade a partial opening of the slot; in a locked state, the slots of the two side sheets are respectively aligned with the two longitudinal long grooves, the lock lever is penetratingly disposed in the two longitudinal long grooves and the slots of the two side sheets, the lock lever is located within the scope of the hook portion, so that the lock lever is clamped by the hook portion, and the two side sheets are limited from pivoting relative to the body; when the gravity lock is inverted, the lock lever can be detached from the scope of the hook portion and switched to an unlocked state of the gravity lock, so that the two side sheets can pivot relative to the body.

In the above folding table, the side sheet of the gravity lock may have a clamping plate and a locking plate, the pivot portion, the slot and the hook portion are all located at the clamping plate, and the side sheet is combined to the first crossbar or the second crossbar by the locking plate, the clamping plate and the locking plate can be connected by an inclined portion; the body can have an intermediate sheet connecting two opposite sheets, the two longitudinal long grooves may be respectively disposed at the two opposite sheets, in the locked state of the gravity lock, the inclined portions of the two side sheets can be aligned at rear end faces of the adjacent opposite sheets.

In the above folding table, the side sheet may have a hollow out portion, extending from the locking plate to the clamping plate through the inclined portion, the locking plate may have an abutting piece protruding in the hollow out portion, in the locked state of the gravity lock, the abutting piece can be abutted to the rear end face of the opposite sheet.

In the above folding table, the first crossbar has two segmented pipes and two end plugs, and the two end plugs are respectively combined with one end of the two segmented pipes, the locking plate of the two side sheets can be combined with one segmented pipe and end plug thereof, and the two opposite sheets can be combined with another segmented pipe and end plug thereof; in the unfolded state of the table frame, the two end plugs can be abutted against each other and form the folding part of the first crossbar.

In the above folding table, the first crossbar and the second crossbar each have an inner flange, and the table plate is detachably disposed at the two inner flanges.

In the above folding table, the table plate has a plurality of unit plates, the plurality of unit plates are placed side by side at the two inner flanges, and any two adjacent unit plates are abutted by at least one spacer pad.

In the above folding table, the first side support set may have two upper rods and two lower rods, one end of the two upper rods is pivoted and combined with a horizontal locking sheet, and the other ends respectively form the two upper junctions; one end of the two lower rods is pivoted, and the other ends respectively form the two lower junctions, and two ends of the horizontal locking sheet are pivoted to the two lower rods.

In the above folding table, the two first side stands may each have an outer pipe and an inner pipe that are partially sleeved, the first side support set may have two pipe sleeves, the two pipe sleeves are respectively sleeved on the two outer pipes, and for pivoting the two lower junctions, the first side support set may have two elastic locking members respectively disposed at the two pipe sleeves, when the elastic locking member is not pressed, the inner pipe can be limited from stretching and contracting relative to the outer pipe.

Accordingly, the folding table of the present disclosure has the table plate and the table frame that are detachable, in the process of switching the table frame from the unfolded state to the folded state, it has undergone a volume reduction of multiple dimensions, so that the volume of the overall table frame can be greatly reduced, so that it can be easily placed in a narrow space (such as the rear compartment of a car), and the convenience of storage or movement is improved, so it is very suitable for being used in the occasion that the table needs to be carried frequently and used outdoors. In addition, in the process of switching to the unfolded or folded state of the table frame, the gravity lock can be automatically locked or unlocked, so that it can further improve the convenience and efficiency of operation, as well as the safety of use.

DETAILED DESCRIPTION OF THE INVENTION

To facilitate understanding of the purpose, characteristics and effects of the present disclosure, embodiments together with the attached drawings for the detailed description of the present disclosure are provided as below.

Figure 1:
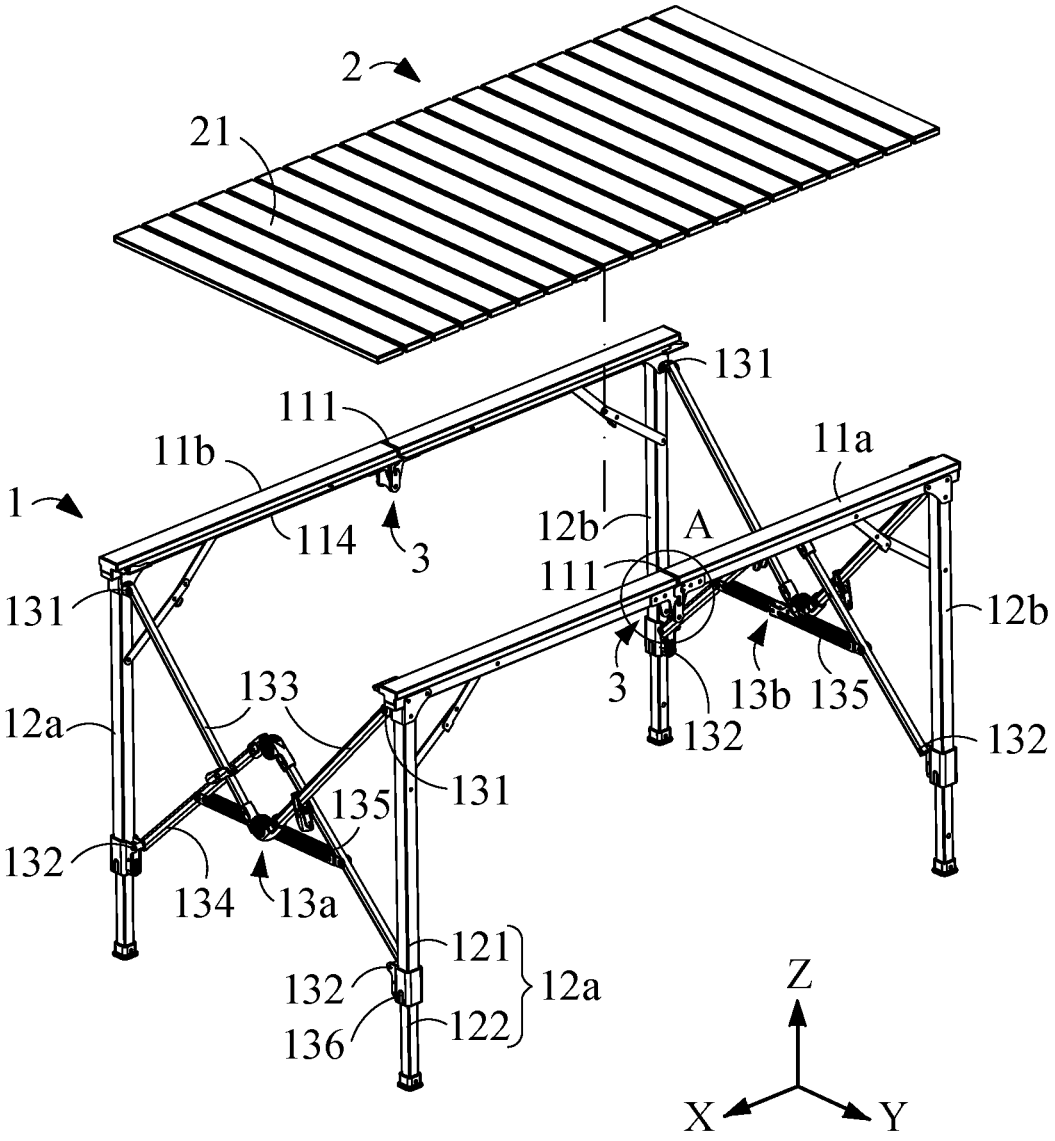
FIG. 1 is a schematic perspective exploded view of an embodiment of the present disclosure.

Referring to FIG. 1, FIG. 1 is a preferable embodiment of a folding table of the present disclosure, the folding table includes a table frame 1, a table plate 2 and at least one gravity lock 3, the table plate 2 is detachably disposed at the table frame 1, and the gravity lock 3 is disposed at the table frame 1.

In detail, the table frame 1 has a first crossbar 11*a* and a second crossbar 11*b* spaced apart in a Y direction in an unfolded state, the first crossbar 11*a* and the second crossbar 11*b* can each extend along a X direction, and the first crossbar 11*a* and the second crossbar 11*b* each have a folding portion 111. Two first side stands 12*a* are respectively pivoted to first ends of the first crossbar 11*a* and the second crossbar 11*b*, and two second side stands 12*b* are respectively pivoted to second ends of the first crossbar 11*a* and the second crossbar 11*b*; the two first side stands 12*a* and the two second side stands 12*b* can each extend along a Z direction. The table frame 1 also has a first side support set 13*a* and a second side support set 13*b* spaced apart in the X direction, and the first side support set 13*a* is respectively pivoted to the two first side stands 12*a* by two upper junctions 131 and two lower junctions 132; the second side support set 13*b* is respectively pivoted to the two second side stands 12*b* by two upper junctions 131 and two lower junctions 132.

The table plate 2 is detachably mounted on the first crossbar 11*a* and the second crossbar 11*b*, and covers a space between the first crossbar 11*a* and the second crossbar 11*b*. The gravity lock 3 is disposed at the folding portion 111 of the first crossbar 11*a* and/or the folding portion 111 of the second crossbar 11*b*, so that the first crossbar 11*a* and the second crossbar 11*b* are controlled not to be folded when locked, but can be folded when unlocked.

Referring to FIG. 2 to FIG. 5, the gravity lock 3 has a body 31, a lock lever 32 and two side sheets 33. The body 31 is provided with two longitudinal long grooves 311 spaced apart in the Y direction, and the two longitudinal long grooves 311 each extend along the Z direction. The lock lever 32 is penetratingly disposed in the two longitudinal long grooves 311, and two ends of the lock lever 32 respectively penetrate and extend out of the corresponding longitudinal long grooves 311. The two side sheets 33 are respectively located at two sides of the body 31 in the Y direction, one end of the two side sheets 33 is combined with the first crossbar 11*a* or the second crossbar 11*b*, and the other end is pivoted to the body 31 by a pivot portion 331. The two side sheets 33 are each provided with a slot 332, and a first end 332*a* of the slot 332 is closer to the pivot portion 331 than a second end 332*b*; the two side sheets 33 each have a hook portion 333 extending from the first end 332*a* to the second end 332*b* of the slot 332, so as to shade a partial opening of the slot 332 by the hook portion 333.

Figure 4:
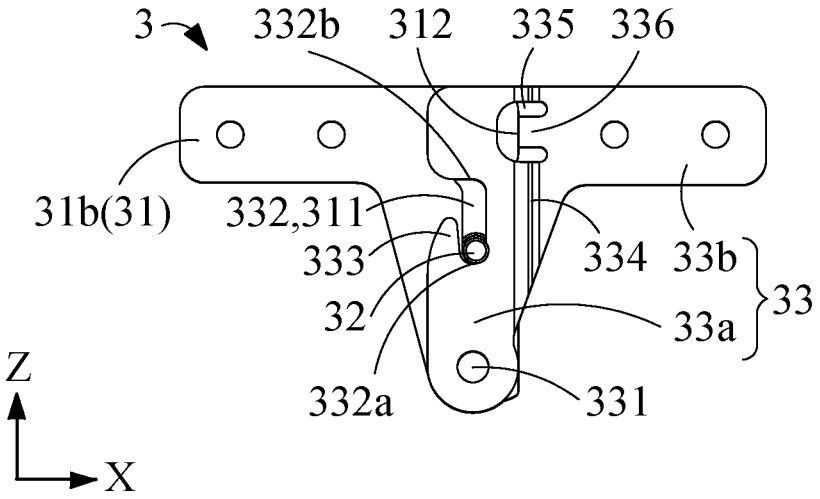
FIG. 4 is a side view of the gravity lock being in a locked state of an embodiment of the present disclosure.

The gravity lock 3 is in the locked state as shown in FIG. 4, the slots 332 of the two side sheets 33 are respectively aligned with the two longitudinal long grooves 311 of the body 31, and the two ends of the lock lever 32 can respectively penetrate the slots 332 of the two side sheets 33; at this time, the lock lever 32 is located at the first end 332*a* of the slot 332 by gravity, and is located within the scope of the hook portion 333, so that the lock lever 32 is clamped by the hook portion 333, and the two side sheets 33 are limited from pivoting relative to the body 31.

Figure 5:
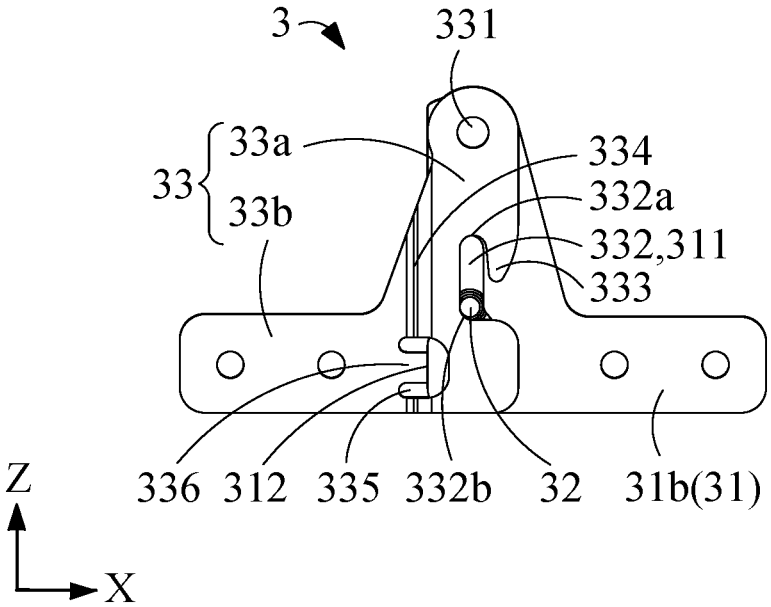
FIG. 5 is a side view of the gravity lock being in an unlocked state of an embodiment of the present disclosure.

The gravity lock 3 can be inverted to switch the gravity lock 3 to the unlocked state as shown in FIG. 5. That is, at this time, the lock lever 32 can be affected by gravity and fall towards the second end 332*b* of the slot 332, thereby detaching from the scope of the hook portion 333, so that the two side sheets 33 can pivot relative to the body 31.

Figure 2:
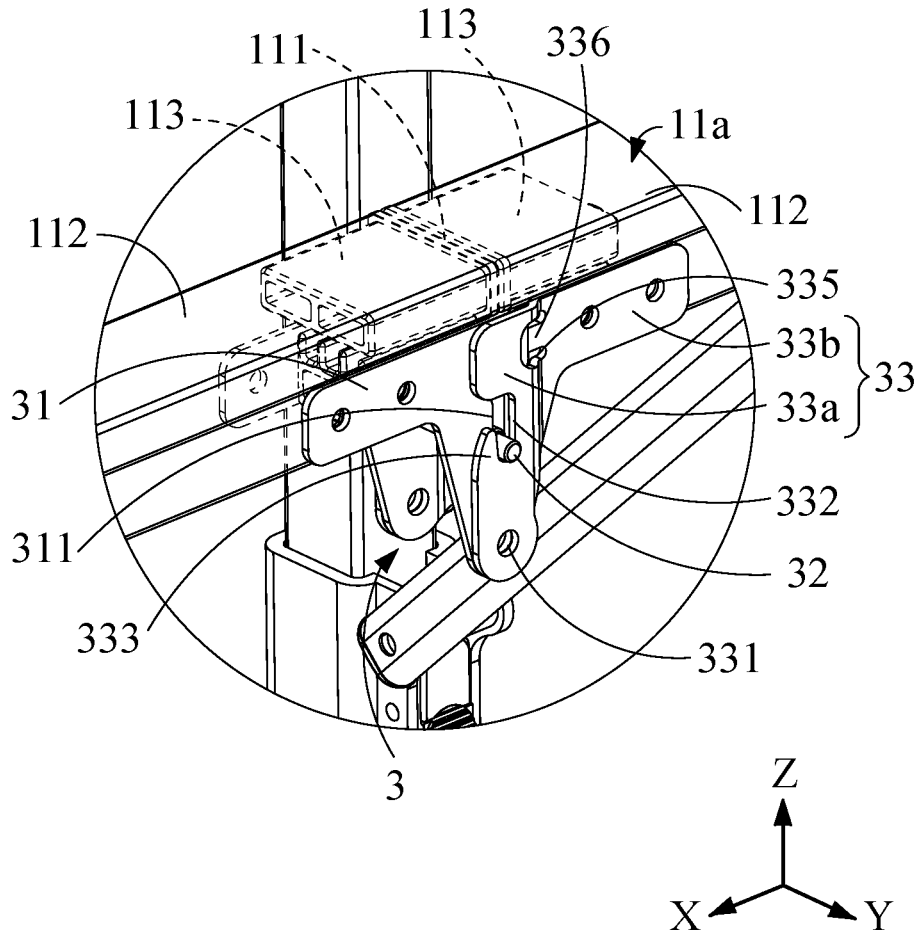
FIG. 2 is an enlarged view of area A in FIG. 1.

Referring to FIG. 1 and FIG. 2, in the unfolded state of the folding table, because the two side sheets 33 of the gravity lock 3 are facing downwards with the first end 332*a* of the slot 332, the gravity lock 3 can automatically appear locked, so that the folding parts 111 of the first crossbar 11*a* and the second crossbar 11*b* are limited by the gravity lock 3 and cannot be folded, and the unfold state can be remained in a straight line, so that the situation that the folding table is accidentally deformed in use can be avoided.

Figure 6:
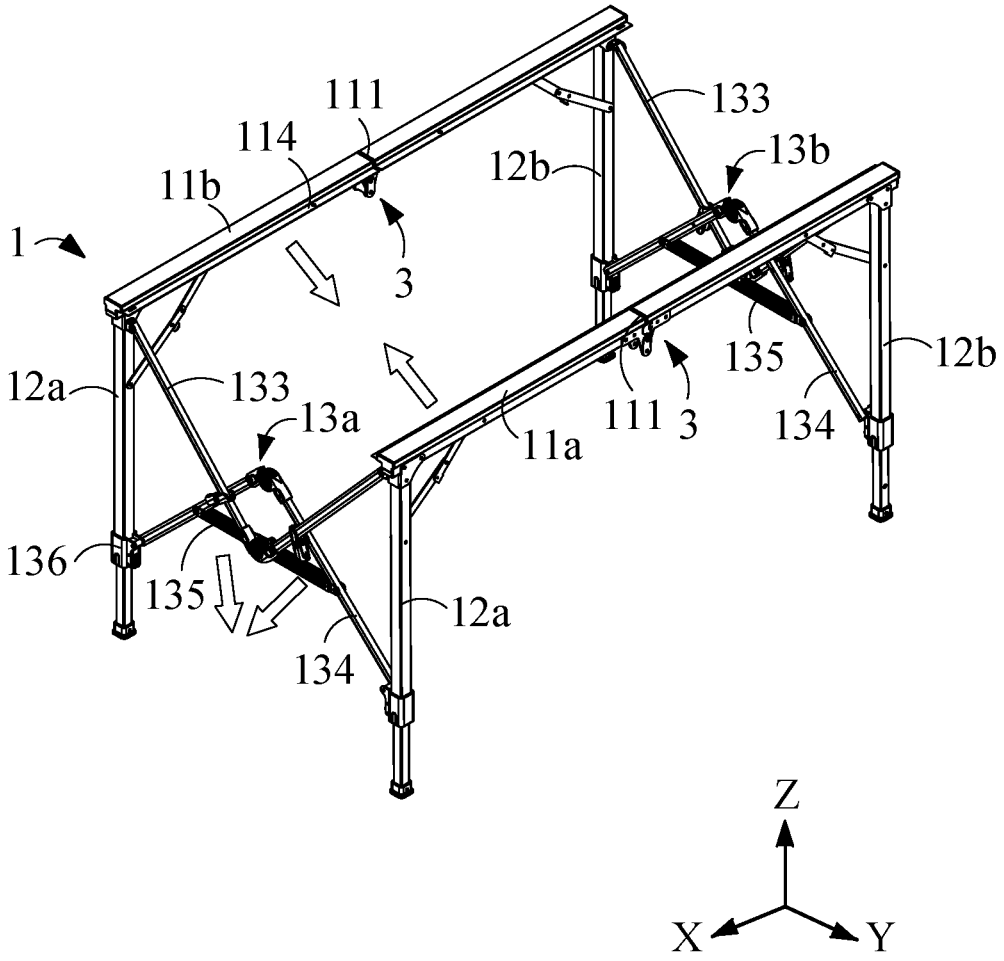
FIG. 6 is a schematic view of folding action of the table frame from an unfolded state of an embodiment of the present disclosure.
Figure 7:
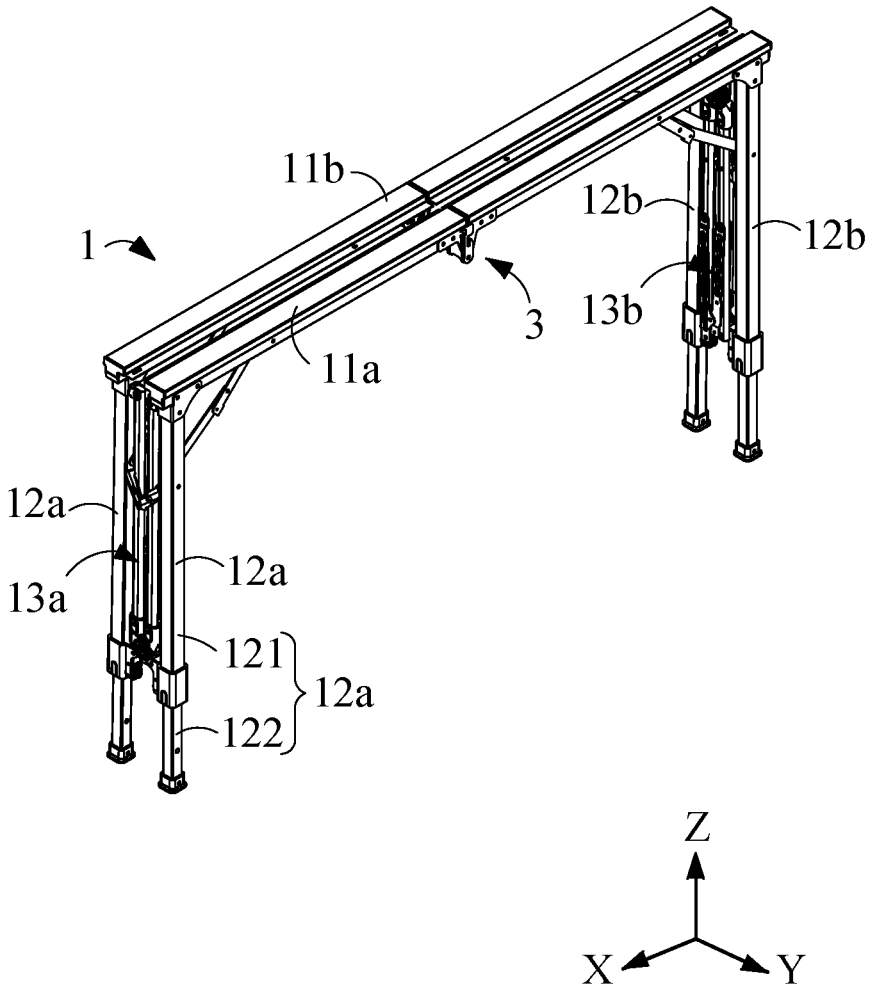
FIG. 7 is a schematic perspective view of a first crossbar and a second crossbar of the table frame being brought together of an embodiment of the present disclosure.

Referring to FIG. 1, FIG. 6 and FIG. 7, to fold the folding table, the table plate 2 may be detached from the first crossbar 11*a* and the second crossbar 11*b*. Then, as shown in FIG. 6, the first side support set 13*a* and the second side support set 13*b* are folded, so that the first crossbar 11*a* and the second crossbar 11*b* can be brought together to form the state shown in FIG. 7, and the volume of the folding table in the Y direction is reduced. At this time, the gravity lock 3 remains in the locked state.

Figure 8:
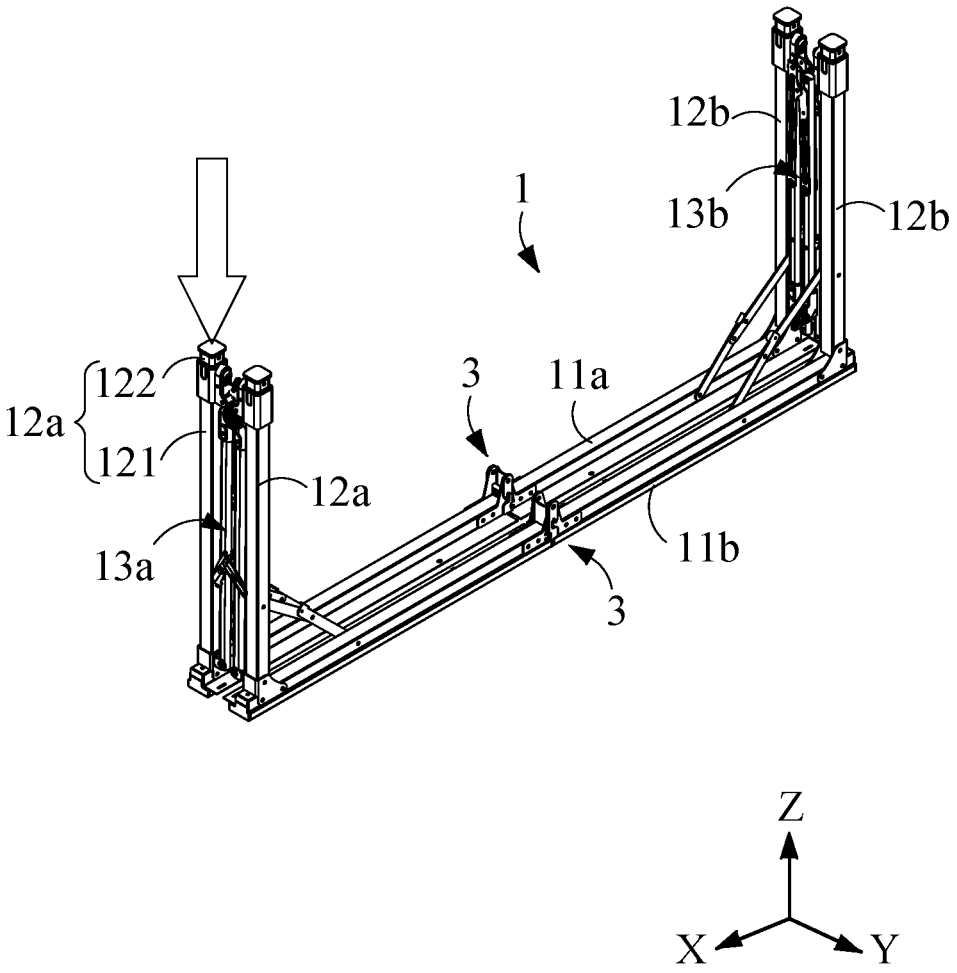
FIG. 8 is a schematic perspective view of a folding table in the inverted state of FIG. 7.

Referring to FIG. 8, continuously, the folding table is inverted, the first crossbar 11*a* and the second crossbar 11*b* are placed on the ground, and the two first side stands 12*a* and the two second side stands 12*b* are facing upwards. At this time, referring to FIG. 5 together, the gravity lock 3 can be automatically switched to the unlocked state because of inversion.

Figure 9:
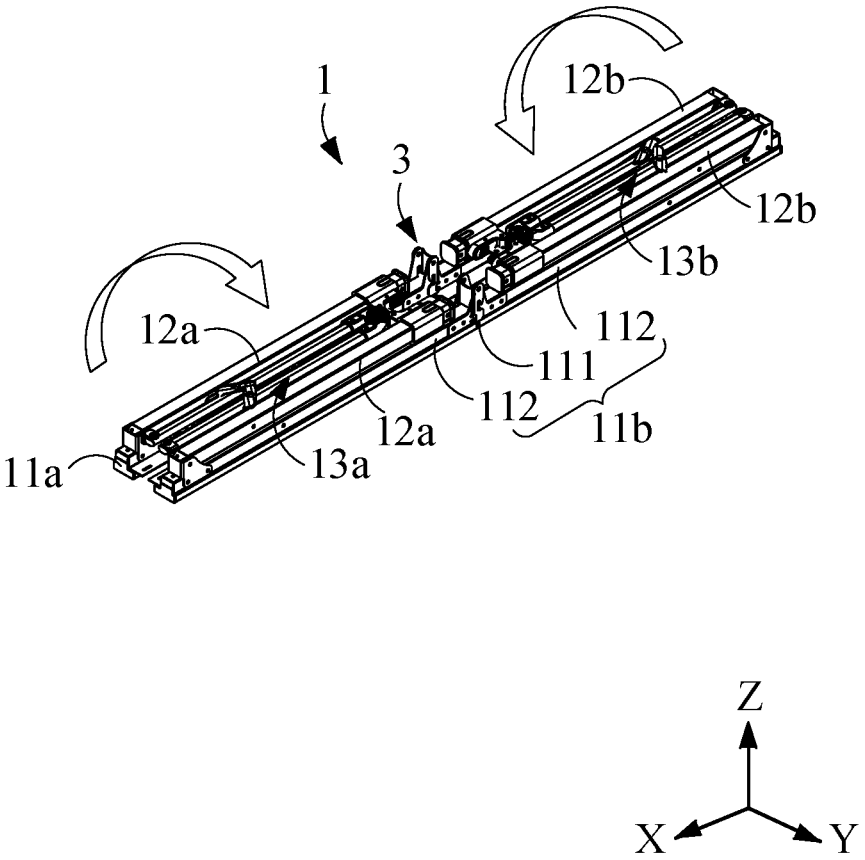
FIG. 9 is a schematic view of the action when folding the stands.

Referring to FIG. 9, continuously, the second first side post 12*a* and the two second side stands 12*b* are folded inward to reduce the volume of the folding table in the Z direction.

Figure 10:
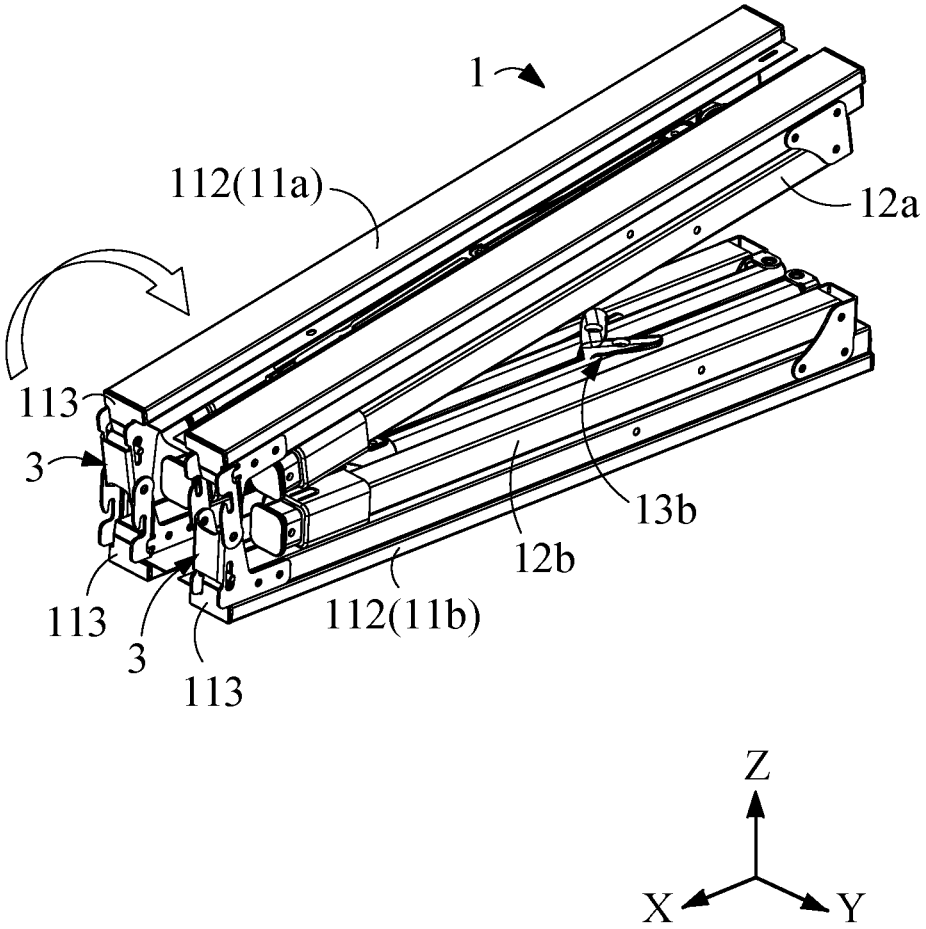
FIG. 10 is a schematic view of the action when folding the first crossbar and the second crossbar.
Figure 11:
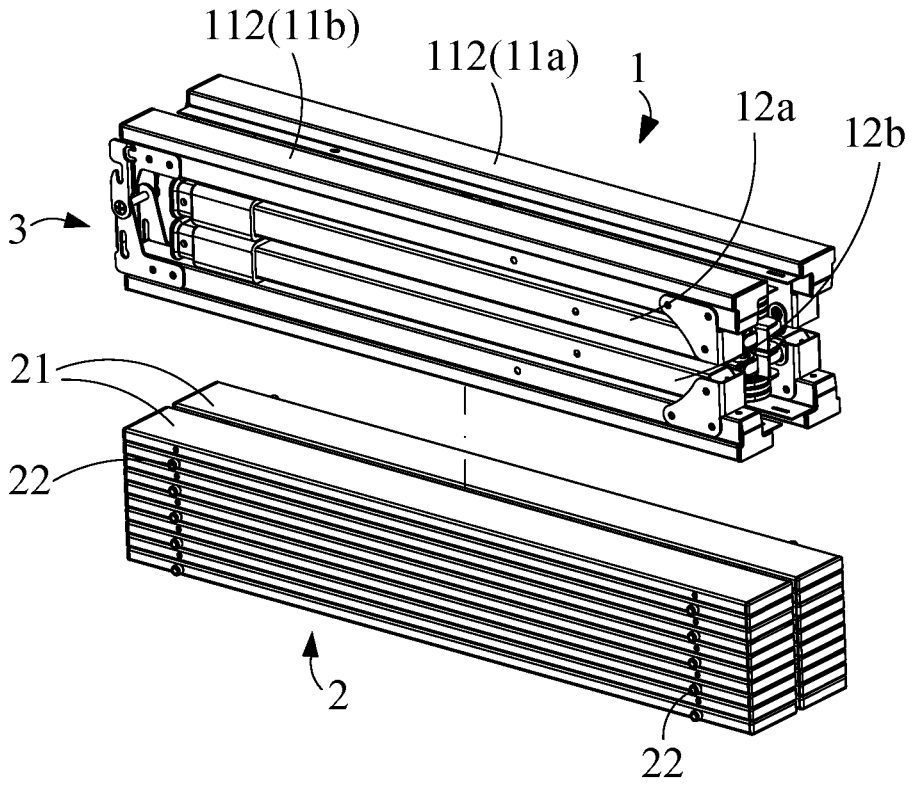
FIG. 11 is a schematic perspective view of both the table frame and the table plate being in the folded state of an embodiment of the present disclosure.
Figure 12:
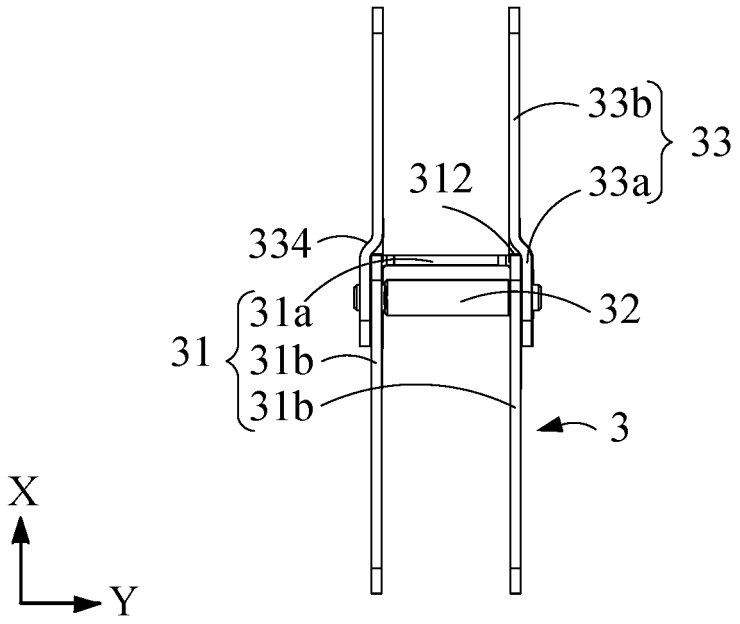
FIG. 12 is a top view of the gravity lock being in a locked state of an embodiment of the present disclosure.

Referring to FIG. 5 and FIG. 10, because the gravity lock 3 has been switched to the unlocked state, the first crossbar 11*a* and the second crossbar 11*b* can be folded successively according to their respective folding portions 111, so as to reduce the volume of the folding table in the X direction, so that the table frame 1 can be converted into a folded state as shown in FIG. 11.

Conversely, to switch the table frame 1 from the folded state back to the unfolded state, the user only needs to reverse the preceding steps. Among them, when the table frame 1 changes to the state shown in FIG. 7, the gravity lock 3 can automatically switch back to the locked state.

Therefore, regarding the folding table of the present embodiment, in the process of switching the table frame 1 from the unfolded state to the folded state, it has undergone a volume reduction of three dimensions, so that the volume of the overall table frame 1 can be greatly reduced, so that it can be easily placed in a narrow space (such as the rear compartment of a car), and the convenience of storage or movement is improved, so it is very suitable for being used in the occasion that the table needs to be carried frequently and used outdoors. In addition, in the process of switching to the unfolded or folded state of the table frame 1, the gravity lock 3 can be automatically locked or unlocked, so that it can further improve the convenience and efficiency of operation, as well as the safety of use.

Referring to FIG. 2 to FIG. 4 and FIG. 12, in addition to the above embodiments, in one embodiment of the present disclosure, the side sheet 33 of the gravity lock 3 may have a clamping plate 33*a* and a locking plate 33*b*, the pivot portion 331, the slot 332 and the hook portion 333 are all located at the clamping plate 33*a*, and the side sheet 33 is combined to the first crossbar 11*a* or the second crossbar 11*b* by the locking plate 33*b*; the clamping plate 33*a* and the locking plate 33*b* can be connected by an inclined portion 334, and the side sheet 33 may be approximately L-shaped. The body 31 has an intermediate sheet 31*a* connecting two opposite sheets 31*b*, and the two opposite sheets 31*b* can be opposite in the Y direction, so that the cross-section of the lower half of the body 31 on the XY plane may be approximately U-shaped, and the two longitudinal long grooves 311 may be respectively disposed at the two opposite sheets 31*b*. In the locked state of the gravity lock 3, the clamping plates 33*a* of the two side sheets 33 can be respectively located at the opposite outer sides of the two opposite sheets 31*b*, and the slots 332 of the two side sheets 33 can be respectively aligned at the two longitudinal long grooves 311, and the inclined portions 334 of the two side sheets 33 can be aligned at rear end faces 312 of the adjacent opposite sheets 31*b*. In this way, the gravity lock 3 of the present embodiment can be firmly combined to the two sides of the first crossbar 11*a* or the second crossbar 11*b* by the two side sheets 33 and the two opposite sheets 31*b* of the body 31 respectively, and has the effect of improving the convenience of assembly.

In addition to the above embodiments, in one embodiment of the present disclosure, the side sheet 33 may have a hollow out portion 335, the hollow out portion 335 may extend from the locking plate 33*b* to the clamping plate 33*a* through the inclined portion 334, and the locking plate 33*b* may also have an abutting piece 336 protruding in the hollow out portion 335. In the locked state of the gravity lock 3, the abutting piece 336 can be abutted to the rear end face 312 of the opposite sheet 31*b*. In this way, the gravity lock 3 of the present embodiment can limit the approaching position of the locking plate 33*b* and the opposite sheet 31*b* by a simple structure that is easy to form, so that the corresponding slot 332 and the longitudinal long groove 311 can be accurately opposed, the locking lever 32 is remained without being clamped and can be smoothly switched in the groove by the action of gravity.

Figure 3:
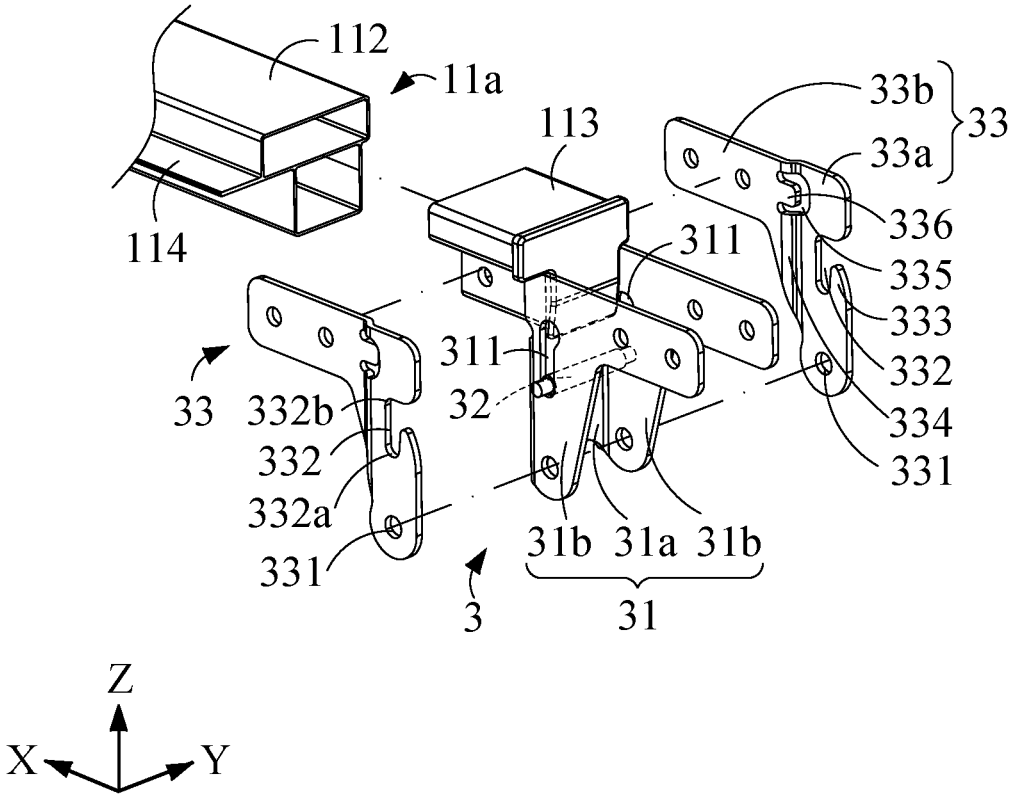
FIG. 3 is a schematic perspective exploded view of a gravity lock and a partial table frame of an embodiment of the present disclosure.

Referring to FIG. 2 and FIG. 3, in addition to the above embodiments, in one embodiment of the present disclosure, the first crossbar 11*a* has two segmented pipes 112 and two end plugs 113, and the two end plugs 113 are respectively combined with one end of the two segmented pipes 112. The locking plate 33*b* of the two side sheets 33 is combined with one segmented pipe 112 and end plug 113 thereof, and the two opposite sheets 31*b* are combined with another segmented pipe 112 and end plug 113 thereof; in the unfolded state of the table frame 1, the two end plugs 113 are abutted against each other and form the folding part 111 of the first crossbar 11*a*. In this way, the embodiment can achieve that the first crossbar 11*a* is convenient for being unfolded or folded in the X direction by a simple structure. The second crossbar 11*b* has the same structure as the first crossbar 11*a* with two segmented pipes 112 and two end plugs 113, so they are not described in detail herein.

Referring to FIG. 1 and FIG. 3, in addition to the above embodiments, in one embodiment of the present disclosure, the first crossbar 11*a* and the second crossbar 11*b* each have an inner flange 114, and the table plate 2 is detachably disposed at the two inner flanges 114. In this way, the table frame 1 of the present embodiment can be used for firmly mounting the table plate 2 by a simple structure and is convenient for disassembling or assembling, and has the effects such as improving the operation convenience and efficiency when disassembling or assembling.

Figure 13:
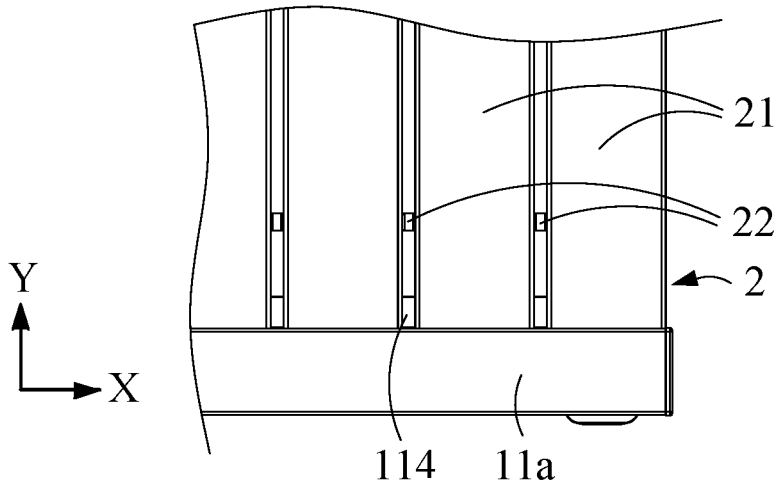
FIG. 13 is a schematic partial top view of the table frame of an embodiment of the present disclosure.

Referring to FIG. 1 and FIG. 13, in addition to the above embodiment, in one of the embodiments of the present disclosure, the table plate 2 has a plurality of unit plates 21, the plurality of unit plates 21 are placed side by side at the two inner flanges 114, and any two adjacent unit plates 21 are abutted by at least one spacer pad 22. In this way, the embodiment can provide the user to quickly place the plurality of unit plates 21 side by side at the two inner flanges 114 at equal intervals to form the table board 2, and the plurality of unit plates 21 can be conveniently disassembled and stored and stacked into a small volume as shown in FIG. 11, so as to improve the convenience when storing or moving.

Figure 14:
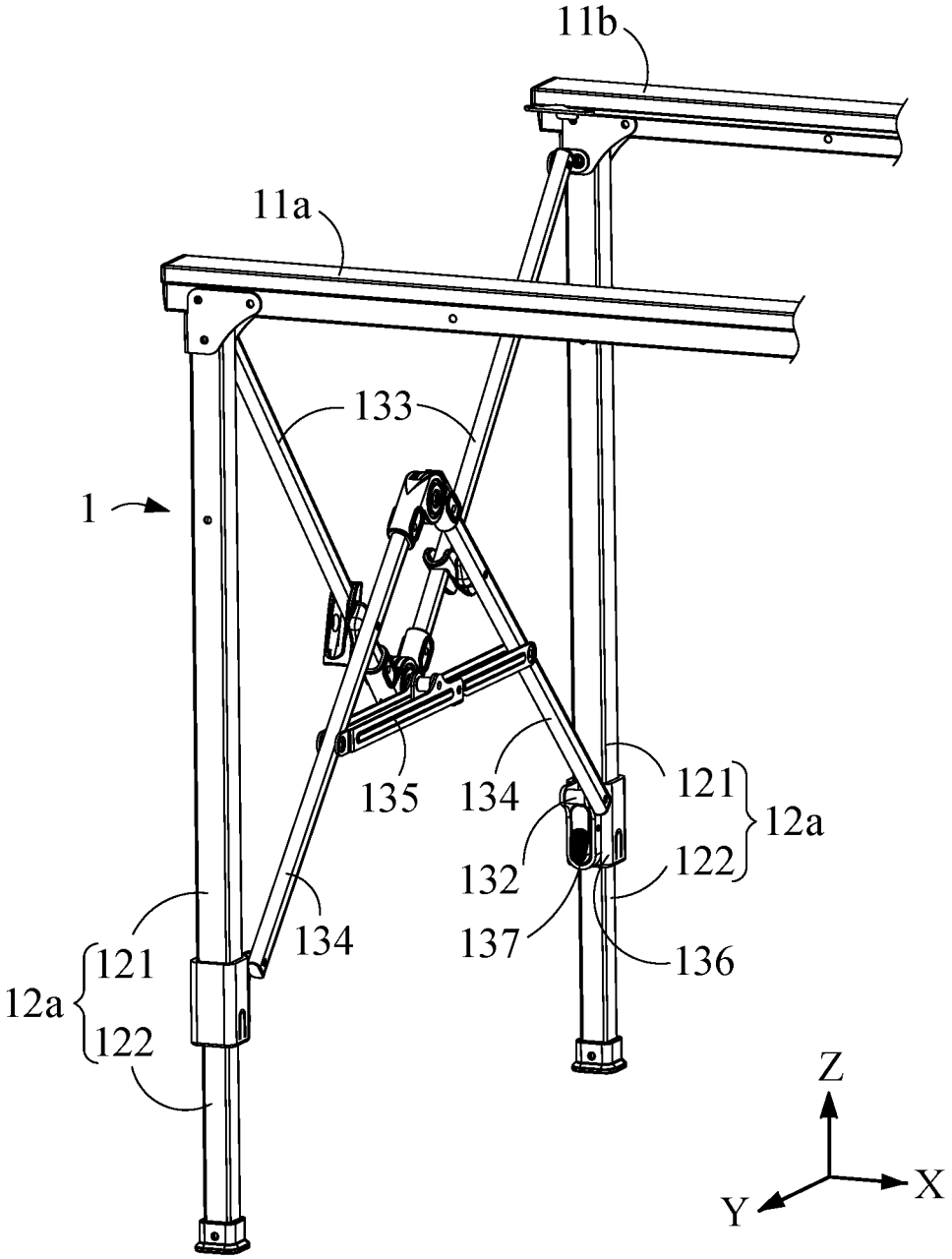
FIG. 14 is schematic perspective view of the table frame being an unfolded state from another viewing angle of an embodiment of the present disclosure.

Referring to FIG. 1 and FIG. 14, in addition to the above embodiments, in one embodiment of the present disclosure, the first side support set 13*a* may have two upper rods 133 and two lower rods 134, one end of the two upper rods 133 is pivoted and combined with a horizontal locking sheet 135, and the other ends respectively form the two upper junctions 131; one end of the two lower rods 134 is pivoted, and the other ends respectively form the two lower junctions 132, and two ends of the horizontal locking sheet 135 are pivoted to the two lower rods 134. In this way, the first side support set 13*a* of the present embodiment can remain the opening state of the two lower rods 134 and simultaneously limit the opening state of the two upper rods 133 when the horizontal locking sheet 135 is unfolded into a straight line; during the folding step as shown in FIG. 6, the horizontal locking sheet 135 can be pushed down and bent, so that the first side support set 13*a* can be folded. The second side support set 13*b* has the same structure as the first side support set 13*a* with the two upper rods 133, the two lower rods 134 and the horizontal locking sheet 135, they are not described in detail herein.

In addition to the above implementation, in one embodiment of the present disclosure, the two first side stands 12*a* may each have an outer pipe 121 and an inner pipe 122 that are partially sleeved; the first side support set 13*a* may have two pipe sleeves 136, the two pipe sleeves 136 are respectively sleeved on the two outer pipes 121, and for pivoting the two lower junctions 132, the first side support set 13*a* may have two elastic locking members 137, the two elastic locking members 137 are respectively disposed at the two pipe sleeves 136, when the elastic locking member 137 is not pressed, the inner pipe 122 can be limited from stretching and contracting relative to the outer pipe 121; when the length of the first side stand 12*a* is to be adjusted, the elastic locking member 137 can be pressed, so that the inner pipe 122 can be stretched and contracted relative to the outer pipe 121. During the folding step as shown in FIG. 8, the elastic locking member 137 can be pressed first, and the first side stand 12*a* is reduced to shortest, and then folded toward the first crossbar 11*a* or the second crossbar 11*b*. The two second side stands 12*b* can also have an outer pipe 121 and an inner pipe 122 that are partially sleeved, and the second side support set 13*b* has the same structure as the first side support set 13*a* with two pipe sleeves 136 and two elastic locking members 137, so they are not described in detail herein. In this way, the embodiment can facilitate the adjustment of the length of the two first side stands 12*a* and the two second side stands 12*b*.

While the present invention has been described by means of preferable embodiments, those skilled in the art should understand the above description is merely for describing the invention, and it should not be considered to limit the scope of the invention. It should be noted that all changes and substitutions which come within the meaning and range of equivalency of the embodiments are intended to be embraced in the scope of the invention. Therefore, the scope of the invention is defined by the claims.

What is claimed is:

1. A folding table, comprising:

a table frame, having a first crossbar, a second crossbar, two first side stands and two second side stands, the first crossbar and the second crossbar each have a folding portion, the two first side stands are respectively pivoted to first ends of the first crossbar and the second crossbar, and two second side stands are respectively pivoted to second ends of the first crossbar and the second crossbar, a first side support set is respectively pivoted to the two first side stands by two upper junctions and two lower junctions; a second side support set is respectively pivoted to the two second side stands by two upper junctions and two lower junctions;

a table plate, when the table frame is in an unfolded state, the table plate is detachably mounted on the first crossbar and the second crossbar; and at least one gravity lock, disposed at the folding portion of the first crossbar and/or the folding portion of the second crossbar, the gravity lock has a body, a lock lever and two side sheets, the body is provided with two longitudinal long grooves, the two side sheets are respectively located at two sides of the body, one end of the two side sheets is combined with the first crossbar or the second crossbar, and the other end is pivoted to the body by a pivot portion, the two side sheets are each provided with a slot, and a first end of the slot is closer to the pivot portion than a second end, the two side sheets each have a hook portion extending from the first end to the second end of the slot to shade a partial opening of the slot; in a locked state, the slots of the two side sheets are respectively aligned with the two longitudinal long grooves, the lock lever is penetratingly disposed in the two longitudinal long grooves and the slots of the two side sheets, the lock lever is located within the scope of the hook portion, so that the lock lever is clamped by the hook portion, and the two side sheets are limited from pivoting relative to the body; when the gravity lock is inverted, the lock lever can be detached from the scope of the hook portion and switched to an unlocked state of the gravity lock, so that the two side sheets can pivot relative to the body, wherein the side sheet of the gravity lock has a clamping plate and a locking plate, the pivot portion, the slot and the hook portion are all located at the clamping plate, and the side sheet is combined to the first crossbar or the second crossbar by the locking plate, the clamping plate and the locking plate are connected by an inclined portion; the body has an intermediate sheet connecting two opposite sheets, the two longitudinal long grooves are respectively disposed at the two opposite sheets, in the locked state of the gravity lock, the inclined portions of the two side sheets are aligned at rear end faces of the adjacent opposite sheets, and wherein the side sheet has a hollow out portion, extending from the locking plate to the clamping plate through the inclined portion, the locking plate has an abutting piece protruding in the hollow out portion, in the locked state of the gravity lock, the abutting piece is abutted to the rear end face of the opposite sheet.

2. The folding table according to claim 1, wherein the first crossbar and the second crossbar each have an inner flange, and the table plate is detachably disposed at the two inner flanges.

3. The folding table according to claim 2, wherein the table plate has a plurality of unit plates, the plurality of unit plates are placed side by side at the two inner flanges, and any two adjacent unit plates are abutted by at least one spacer pad.

4. The folding table according to claim 1, wherein the first side support set has two upper rods and two lower rods, one end of the two upper rods is pivoted and combined with a horizontal locking sheet, and the other ends respectively form the two upper junctions; one end of the two lower rods is pivoted, and the other ends respectively form the two lower junctions, and two ends of the horizontal locking sheet are pivoted to the two lower rods.

5. The folding table according to claim 4, wherein the two first side stands each have an outer pipe and an inner pipe that are partially sleeved, the first side support set has two pipe sleeves, the two pipe sleeves are respectively sleeved on the two outer pipes, and for pivoting the two lower junctions, the first side support set has two elastic locking members respectively disposed at the two pipe sleeves, when the elastic locking member is not pressed, the inner pipe can be limited from stretching and contracting relative to the outer pipe.

6. A folding table, comprising:

a table frame, having a first crossbar, a second crossbar, two first side stands and two second side stands, the first crossbar and the second crossbar each have a folding portion, the two first side stands are respectively pivoted to first ends of the first crossbar and the second crossbar, and two second side stands are respectively pivoted to second ends of the first crossbar and the second crossbar, a first side support set is respectively pivoted to the two first side stands by two upper junctions and two lower junctions; a second side support set is respectively pivoted to the two second side stands by two upper junctions and two lower junctions;

a table plate, when the table frame is in an unfolded state, the table plate is detachably mounted on the first crossbar and the second crossbar; and at least one gravity lock, disposed at the folding portion of the first crossbar and/or the folding portion of the second crossbar, the gravity lock has a body, a lock lever and two side sheets, the body is provided with two longitudinal long grooves, the two side sheets are respectively located at two sides of the body, one end of the two side sheets is combined with the first crossbar or the second crossbar, and the other end is pivoted to the body by a pivot portion, the two side sheets are each provided with a slot, and a first end of the slot is closer to the pivot portion than a second end, the two side sheets each have a hook portion extending from the first end to the second end of the slot to shade a partial opening of the slot; in a locked state, the slots of the two side sheets are respectively aligned with the two longitudinal long grooves, the lock lever is penetratingly disposed in the two longitudinal long grooves and the slots of the two side sheets, the lock lever is located within the scope of the hook portion, so that the lock lever is clamped by the hook portion, and the two side sheets are limited from pivoting relative to the body; when the gravity lock is inverted, the lock lever can be detached from the scope of the hook portion and switched to an unlocked state of the gravity lock, so that the two side sheets can pivot relative to the body, wherein the side sheet of the gravity lock has a clamping plate and a locking plate, the pivot portion, the slot and the hook portion are all located at the clamping plate, and the side sheet is combined to the first crossbar or the second crossbar by the locking plate, the clamping plate and the locking plate are connected by an inclined portion; the body has an intermediate sheet connecting two opposite sheets, the two longitudinal long grooves are respectively disposed at the two opposite sheets, in the locked state of the gravity lock, the inclined portions of the two side sheets are aligned at rear end faces of the adjacent opposite sheets, and wherein the first crossbar has two segmented pipes and two end plugs, and the two end plugs are respectively combined with one end of the two segmented pipes, the locking plate of the two side sheets is combined with one segmented pipe and end plug thereof, and the two opposite sheets are combined with another segmented pipe and end plug thereof; in the unfolded state of the table frame, the two end plugs are abutted against each other and form the folding part of the first crossbar.

* * * * *